US005678431A

United States Patent [19]

Yan

[11] Patent Number: 5,678,431

[45] Date of Patent: Oct. 21, 1997

[54] STRUCTURE OF PADLOCK

[76] Inventor: Yu-Yang Yan, No. 16, Lane 195, Chung-Shan Rd., Hsin-Shih Hsiang, Tainan Hsien, Taiwan

[21] Appl. No.: 626,794

[22] Filed: Apr. 2, 1996

[51] Int. Cl.[6] ..... E05B 67/22

[52] U.S. Cl. ..... 70/39; 70/38 A; 70/38 C; 70/233; 70/DIG. 20

[58] Field of Search ..... 70/28, 31, 35, 70/38–39, 41, 43, 53, 233, 360, 361, 367, DIG. 20

[56] References Cited

U.S. PATENT DOCUMENTS

| | | | |
|---|---|---|---|
| 1,526,728 | 2/1925 | Wagner | 70/43 |
| 4,064,716 | 12/1977 | Shwayder et al. | 70/53 X |
| 4,545,224 | 10/1985 | Zane | 70/39 |
| 4,949,564 | 8/1990 | Barzilai | 70/39 X |
| 4,987,753 | 1/1991 | Kuo | 70/39 |
| 5,195,340 | 3/1993 | Huang | 70/53 X |
| 5,199,282 | 4/1993 | Wang | 70/38 A |
| 5,253,496 | 10/1993 | Wang | 70/53 X |
| 5,331,830 | 7/1994 | Su | 70/38 A |
| 5,379,618 | 1/1995 | Shieh | 70/233 X |
| 5,406,812 | 4/1995 | Jaw | 70/38 A |
| 5,410,895 | 5/1995 | Hsu et al. | 70/39 |
| 5,447,049 | 9/1995 | Shieh | 70/DIG. 20 X |
| 5,490,402 | 2/1996 | Shieh | 70/39 |
| 5,511,400 | 4/1996 | Ma | 70/39 X |

FOREIGN PATENT DOCUMENTS

| | | | |
|---|---|---|---|
| 43548 | 8/1910 | Austria | 70/39 |
| 371515 | 3/1923 | Germany | 70/39 |
| 388160 | 1/1924 | Germany | 70/38 C |
| 491840 | 1/1930 | Germany | 70/38 C |
| 473317 | 7/1952 | Italy | 70/38 C |
| 179212 | 6/1923 | United Kingdom | 70/38 C |

*Primary Examiner*—Suzanne Dino
*Attorney, Agent, or Firm*—Varndell Legal Group

[57] ABSTRACT

A padlock which includes a cylindrical lock body, a shackle having at least one free end detachably inserted into a lock hole on the lock body, a lock cylinder mounted in the lock body at one end and controlled to lock the at least one free end of the shackle, wherein the lock cylinder includes a cylinder case mounted in one end of the lock body and moved axially between the locking position and the unlocking position, a locating pin mounted in a hole on the lock body to stop the cylinder case between the locking position and the unlocking position, a barrel fixedly mounted inside the cylinder case, a spindle mounted in the barrel and turned with a key between the locking position and the unlocking position, a locking device mounted in a hole on the lock body to lock the cylinder case in the locking position when the cylinder case is moved to the looking position, and spring means mounted on the cylinder case to force it from the locking position to the unlocking position when the spindle is turned to the unlocking position.

3 Claims, 7 Drawing Sheets

STRUCTURE OF PADLOCK

BACKGROUND OF THE INVENTION

The present invention relates to padlocks, and relates more particularly to such a padlock which comprises a cylindrical lock body, a shackle detachably connected to the lock body, a lock cylinder mounted in one end of the cylindrical lock body and moved axially to lock the shackle, a looking device to lock the cylinder case in the locking position, and a spring to force the cylinder case from the locking position to the unlocking position when the locking device is unlocked with the key.

FIGS. 1 and 1A shows a padlock according to the prior art. This structure of padlock comprises a cylindrical lock body, a shackle having a fixed end pivoted to one end of the lock body and a notched free end detachably inserted into one look hole on the lock body, and a lock cylinder mounted in the lock body and turned with the key to lock the free end of the shackle. The lock cylinder has a spindle and a locking plate at one end of the spindle. When the spindle is turned with the key, the locking plate is turned radially into engagement with the notch on the free end of the shackle. This structure of padlock is not durable in use, and the locking plate of the spindle tends to be damaged by striking the lock body away from the shackle. When the padlock drops from the hand to the ground, the locking plate of the spindle may be forced to deform, causing the padlock unable to work functionally.

SUMMARY OF THE INVENTION

The present invention has been accomplished to provide a padlock which eliminates the drawbacks of the aforesaid prior art padlock. According to the preferred embodiment of the present invention, the padlock comprises a cylindrical lock body, a shackle having at least one free end detachably inserted into a lock hole on the lock body, a lock cylinder mounted in the lock body at one end and controlled to lock the at least one free end of the shackle, wherein the look cylinder comprises a cylinder case mounted in one end of the look body and moved axially between the locking position and the unlocking position, a locating pin mounted in a hole on the lock body to stop the cylinder case between the locking position and the unlocking position, a barrel fixedly mounted inside the cylinder case, a spindle mounted in the barrel and turned with a key between the locking position and the unlocking position, a locking device mounted in a hole on the lock body to lock the cylinder case in the looking position when the cylinder case is moved to the locking position, and spring means mounted on the cylinder case to force it from the locking position to the unlocking position when the spindle is turned to the unlocking position.

BRIEF DESCRIPTION OF THE DRAWINGS

FIG. 2 is an exploded view of a lock cylinder according to the present invention;

DETAILED DESCRIPTION OF THE PREFERRED EMBODIMENT

Figure 1:
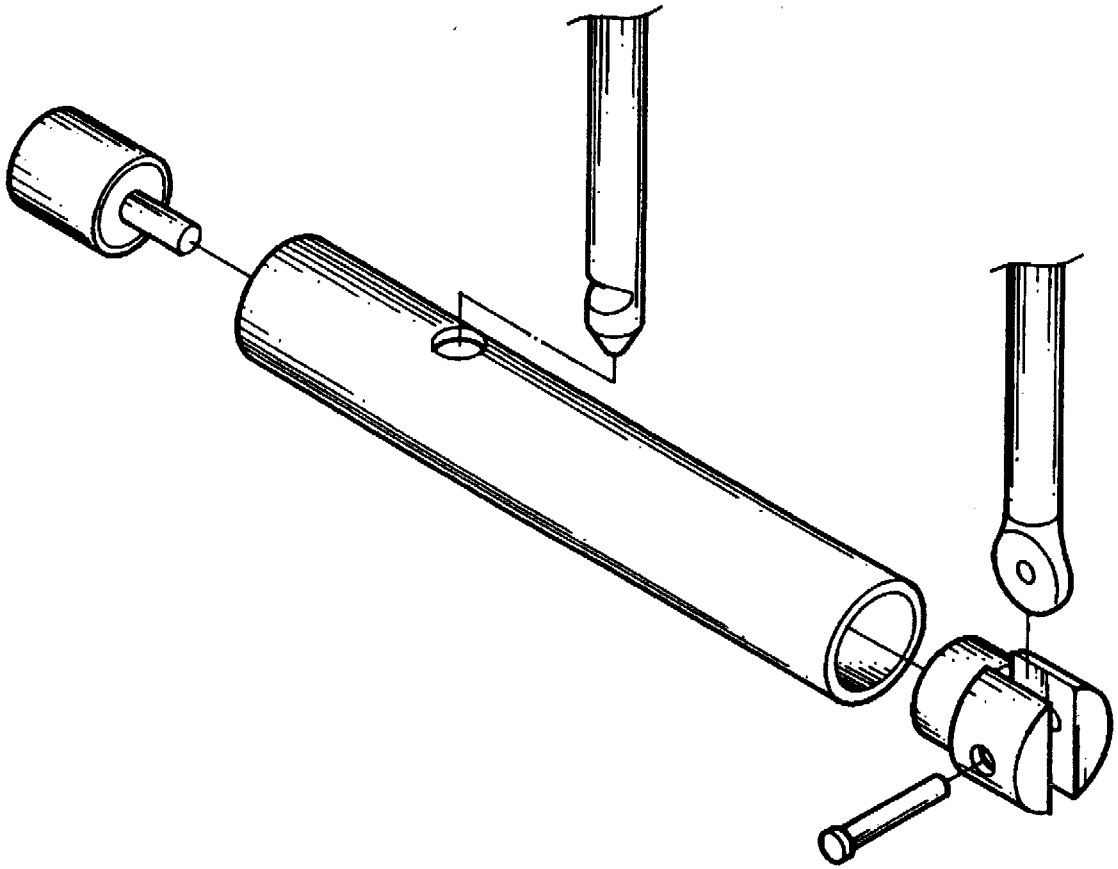
PRIOR ART Fig. 1
FIG. 1 is an exploded view of a padlock according to the prior art.
Figure 1A:
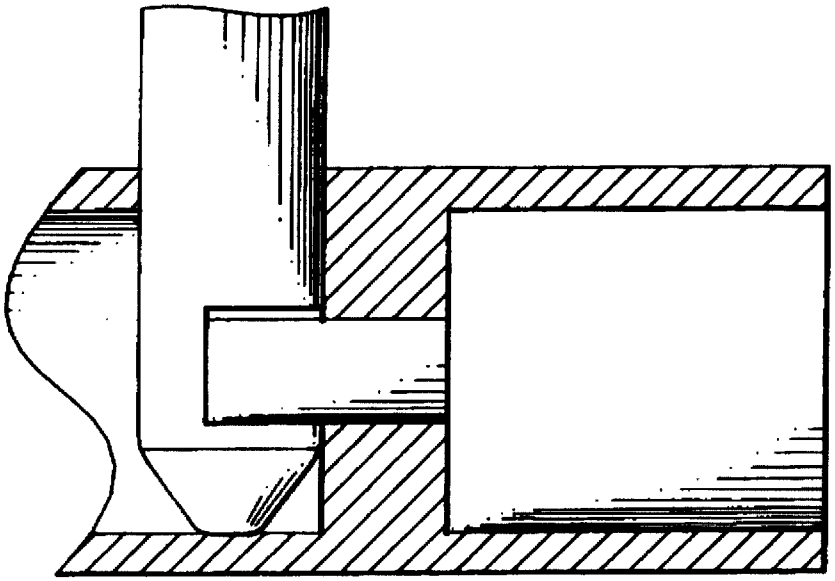
PRIOR ART Fig. 1A
FIG. 1A is a cross-sectional view of the padlock of FIG. 1.
Figure 2:
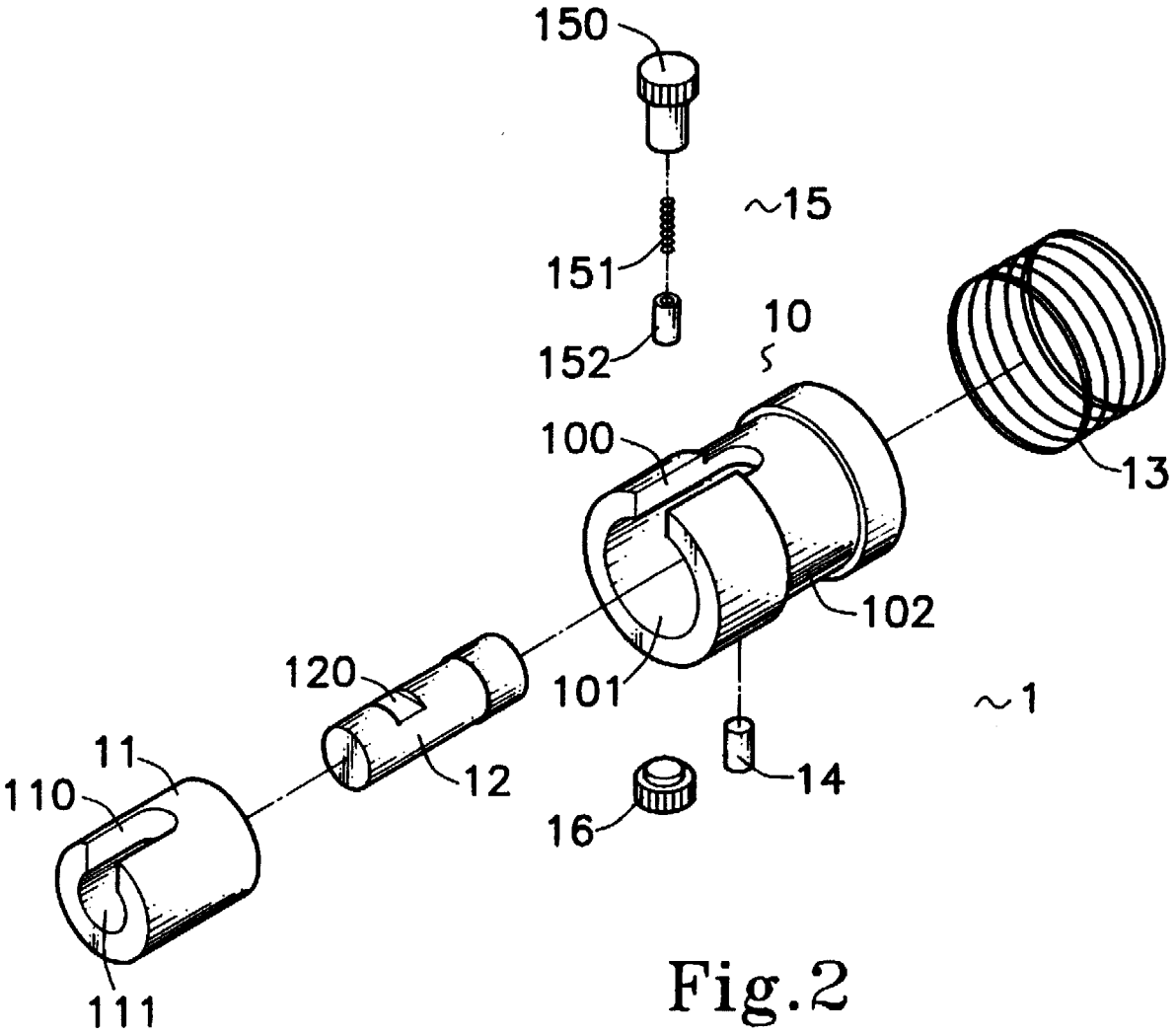
FIG. 2 is a partial view in section of the padlock shown in FIG. 1, showing the free end of the shackle locked.

Referring to FIG. 2, the lock cylinder, referenced by 1, is comprised of a cylinder case 10, a barrel 11, a spindle 12, a spring 13, a pin 14, a locking device 15, and a stop rod 16. The cylinder case 10 is a hollow cylinder having two opposite ends opened, an outside annular groove 202 around the periphery for the mounting of the spring 13, and a longitudinal slot 100 extending from one end namely the front end 101 to a part of the outside annular groove 102. The barrel 11 is mounted inside the cylinder case 10 and secured thereto by the pin 14, having a longitudinal slot 110 extending to one end 111. The barrel 11 is relatively shorter than that of the cylinder case 10, however the size of the longitudinal slot 110 of the barrel 11 is approximately equal to that of the longitudinal slot 100 of the cylinder case 10. The spindle 12 is inserted through the barrel 11 inside the cylinder case 10, having flat notch 120 at the periphery which is disposed beneath the longitudinal slots 110, 100 when the lock cylinder 1 is installed. The locking device 15 is inserted through the longitudinal slot 100, comprised of a bolt 150 mounted in a hole on the lock body 2 of the padlock (see also FIG. 4), a pin 152, and a spring 151 connected between the pin 152 and the bolt 150. The stop rod 16 is fastened to a hole on the lock body 2 of the padlock to stop the cylinder case 10 inside the lock body 2.

Figure 3:
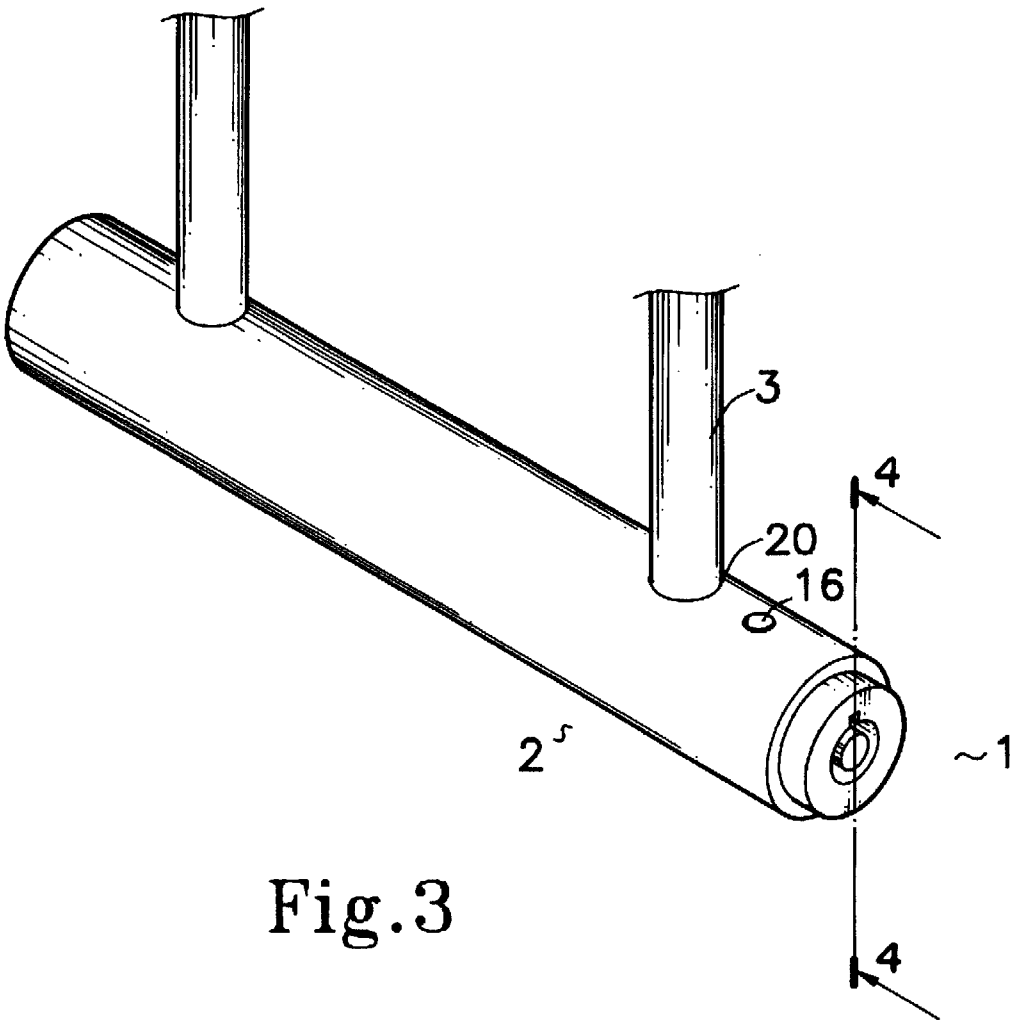
FIG. 3 is an elevational view of a padlock according to the present invention.
Figure 5:
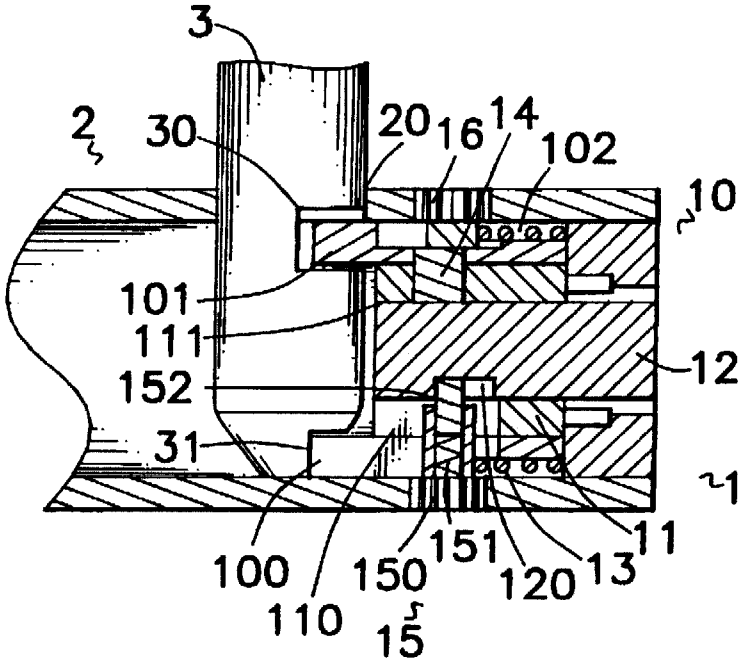
FIG. 5 is similar to FIG. 4 but showing the shackle installed and locked.
Figure 4:
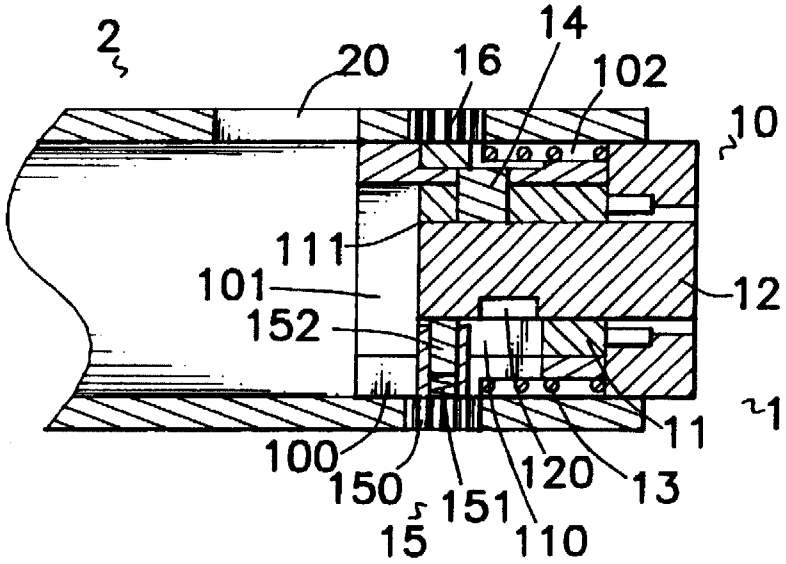
FIG. 4 is a sectional view taken along line 4—4 of FIG. 3 before the installation of the shackle.

Referring to FIGS. 3, 4, and 5, when the look cylinder 1 is installed in the look body 2 of the padlock but not depressed (as shown in FIGS. 3 and 4), the locking device 15 and the stop rod 16 and the spring force of the spring 13 hold the cylinder case 10 inside the lock body 2, the spring 151 is compressed, and the pin 152 is stopped against the periphery of the spindle 12 out of the flat notch 120. When the shackle 3 is inserted into the lock hole 20 of the lock body 2 and the lock cylinder 1 is depressed (as shown in FIG. 5), the cylinder case 10 is moved inwards, the spring 13 is compressed axially against the locking device 15 and the stop rod 16, the flat notch 120 of the spindle 12 is forced into engagement with the pin 152 of the locking device 15, and the front end 101 of the cylinder case 10 is forced into engagement with two vertically spaced retaining notches 30, 31 of the shackle 3. If the spindle 12 is turned with the key, the pin 152 is forced outwards to compress the spring 151. When the pin 152 is moved away from the flat notch 120 of the spindle 12, the lock cylinder 1 immediately trip off from the retaining notches 30, 31, and therefore the shackle 3 is unlocked.

Figure 6:
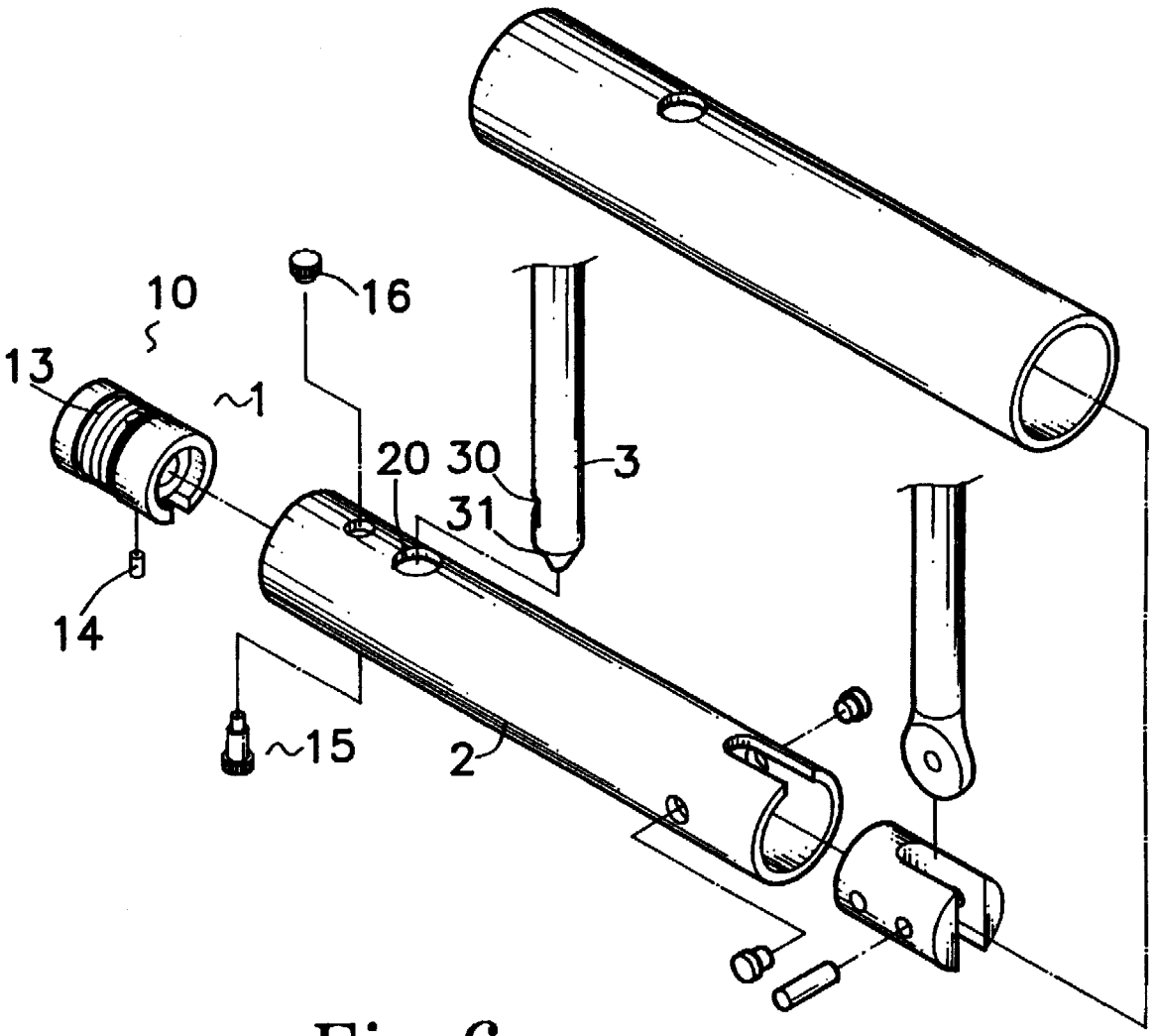
FIG. 6 is an exploded view of the padlock shown in FIG. 3.

Referring to FIG. 6, the shackle 3 has a fixed end pivoted to the lock body 2, and a free end made with two vertically spaced retaining notches 30, 31 for insertion into the lock hole 20 of the lock body 2, and the lock cylinder 1 is installed in one end of the lock body 2 and controlled to lock the free end of the shackle 3 in the lock body 2.

Figure 7:
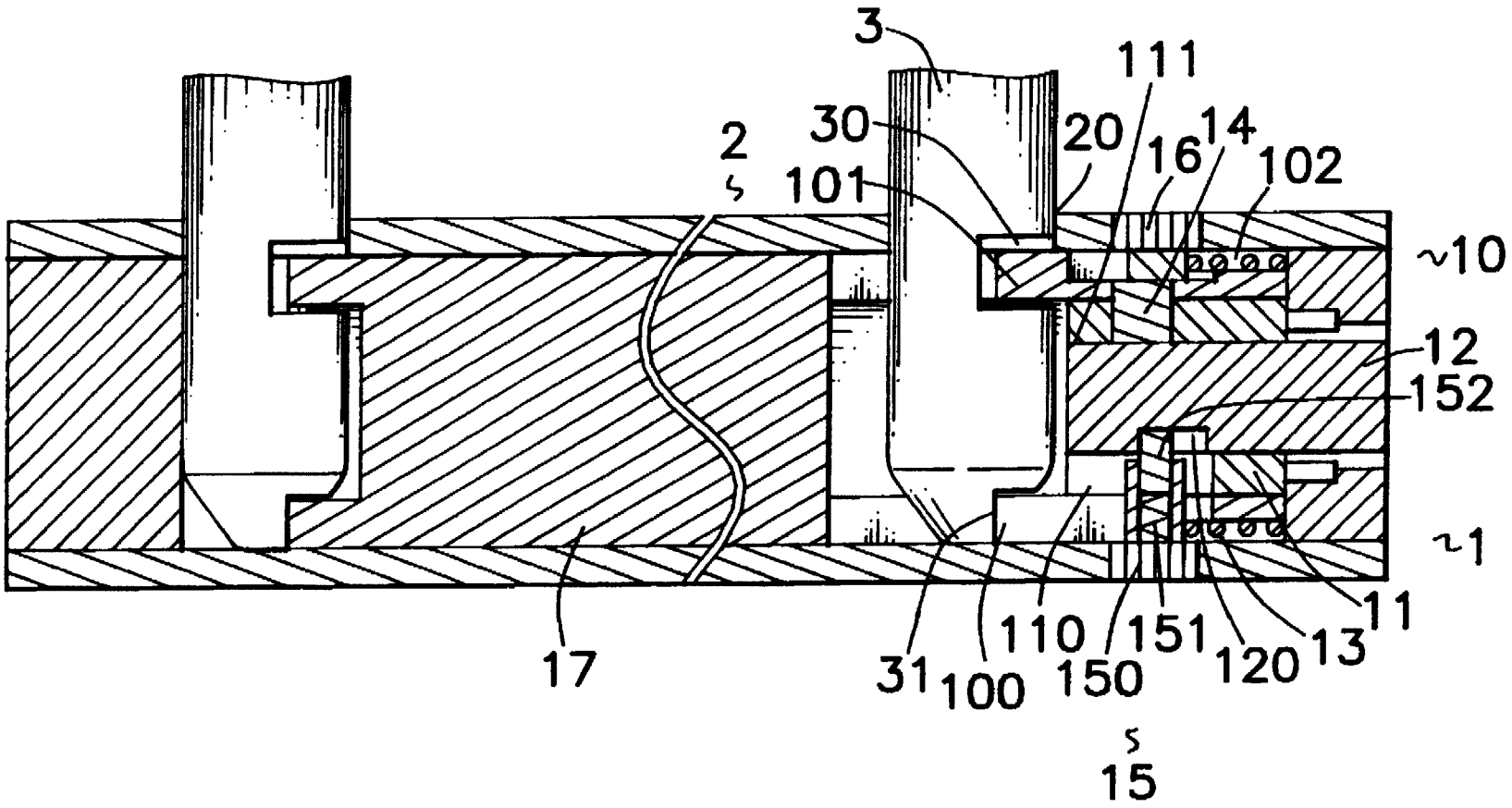
FIG. 7 is a sectional view of an alternate form of the padlock according to the present invention.

In the embodiment shown in FIG. 7, the shackle 3 has two opposite ends detachably connected to the lock body 2, and a solid, forked lock bar 17 is connected to the front end 101 of the cylinder case 10 and moved with the cylinder case 10 to lock the other end of the shackle.

It is to be understood that the drawings are designed for purposes of illustration only, and are not intended as a definition of the limits and scope of the invention disclosed.

I claim:

1. A padlock comprising a cylindrical lock body, a shackle having a free end detachably inserted into a lock hole on said lock body, and a lock cylinder arranged within said lock body at one end thereof and controlled to lock said free end of said shackle, said lock cylinder including a cylinder case mounted in one end of said lock body and axially movable between a locked position and an unlocked position, said cylindrical case having an outside annular groove, a locating pin mounted in a hole on said lock body and received in said annular groove of said cylinder case for restricting movement of said cylinder case between said locked position and said unlocked position, a barrel fixedly mounted inside said cylinder case, said barrel inhibited from axial movement relative to said cylinder case by an interconnected pin received in respective holes of said cylinder case and said barrel, a spindle mounted in said barrel and turned with a key between said locked position and said unlocked position, said cylinder case having a front end which forcibly engaging with one end of said shackle when said cylinder case is moved to said locked position, and a longitudinal slot extending from said front end of said cylinder case into said outside annular groove; said barrel having a longitudinal slot corresponding to said longitudinal slot of said cylinder case; said spindle having a flat notch in alignment with the longitudinal slots of said barrel and said cylinder case when in said locked position, and a locking device mounted in a hole on said lock body for locking said cylinder case in said locked position when said cylinder case is moved to said locked position, and a coil spring mounted around said outside annular groove of said cylinder case for forcing said locking device from said locked position to said unlocked position when said spindle is turned to said unlocked position, said coil spring compressing when said cylinder case is moved to said locked position; said locking device including a bolt fixedly mounted in a hole on said lock body, a pin, and a spring element arranged between said bolt and pin of said locking device, said pin of said locking device forced by the spring of said locking device into engagement with said flat notch of said spindle when said cylinder case is moved to said locked position.

2. The padlock of claim 1, wherein said shackle has a fixed end pivoted to said lock body, and said free end is made with two vertically spaced retaining notches that are forced into engagement with the front end of said cylinder case when said cylinder case is moved to said locked position.

3. The padlock of claim 1, wherein said shackle has a first end and a second end respectively inserted into a respective lock hole on said lock body, said first end and second end of said shackle having a respective pair of vertically spaced retaining notches, said front end of said cylinder case connected to a forked locking bar, said front end of said cylinder case and said forked locking bar being respectively forced into engagement with said vertically spaced retaining notches of said first end and second end of said shackle when said cylinder case is moved to said locked position.

* * * * *